US012757956B2

(12) United States Patent
Liu et al.

(10) Patent No.: US 12,757,956 B2
(45) Date of Patent: Oct. 13, 2026

(54) MULTI-DIMENSIONAL INTELLIGENT GARMENT PRESSURE TEST DRESS FORM APPARATUS AND SYSTEM, AND MULTI-DIMENSIONAL INTELLIGENT GARMENT PRESSURE TEST METHOD

(71) Applicants: THE HONG KONG POLYTECHNIC UNIVERSITY, Hong Kong (CN); Yiwu Yingyun Technology Co., Ltd., Yiwu (CN)

(72) Inventors: Rong Liu, Hong Kong (CN); Shumi Zhao, Hong Kong (CN); Ning Xu, Yiwu (CN)

(73) Assignees: The Hong Kong Polytechnic University, Hong Kong (CN); Yiwu Yingyun Technology Co., Ltd. (CN)

( * ) Notice: Subject to any disclaimer, the term of this patent is extended or adjusted under 35 U.S.C. 154(b) by 0 days.

(21) Appl. No.: 18/684,396

(22) PCT Filed: Aug. 12, 2022

(86) PCT No.: PCT/CN2022/111957
§ 371 (c)(1),
(2) Date: Feb. 16, 2024

(87) PCT Pub. No.: WO2023/020368
PCT Pub. Date: Feb. 23, 2023

(65) Prior Publication Data

US 2024/0349834 A1 Oct. 24, 2024

(30) Foreign Application Priority Data

Aug. 17, 2021 (CN) ..... 202110943459.5

(51) Int. Cl.
*A41H 5/01* (2006.01)

(52) U.S. Cl.
CPC ..... *A41H 5/01* (2013.01)

(58) Field of Classification Search
CPC .... A47F 8/00; A41H 5/00; A41H 5/01; A41H 5/02
See application file for complete search history.

(56) References Cited

U.S. PATENT DOCUMENTS 5,265,779 A * 11/1993 Jiang ..... A41H 5/01 223/66
9,498,011 B2 * 11/2016 Chan ..... A47F 8/00
(Continued)

FOREIGN PATENT DOCUMENTS

CN 101776494 A * 7/2010
CN 101839787 A 9/2010
(Continued)

OTHER PUBLICATIONS

Extended European Search Report; PCT Application No. Application PCT/CN2022111957 Issued from the European Patent Office on Jul. 7, 2025.
(Continued)

*Primary Examiner* — F Griffin Hall
(74) *Attorney, Agent, or Firm* — S&F/WEHRW

(57) ABSTRACT

A multi-dimensional intelligent garment pressure test dress form apparatus and system, and a multi-dimensional intelligent garment pressure test method. The intelligent garment pressure test dress form apparatus comprises an apparatus main body and a human body model (2), wherein the human body model (2) is circumferentially segmented into a plurality of model units (21) around an axis; and the apparatus main body comprises a plurality of movable members (6) and a control base (1). Each movable member (6) is circumferentially distributed on the control base (1) around the center of a circle, and each movable member (6) is movably arranged in a straight line where a connecting line between the center of the movable member and the center of a circle is located; the model units (21) are respectively mounted on the movable members (6) on a one-to-one basis; and the control base (1) is used for driving the movable members (6) to move together or separately, so that multiple dimensions of the size and shape of the human body module (2) can be adjusted and changed. Therefore, when applied to a garment pressure test, the dress form apparatus can implement an intelligent, dynamic and shape-adjustable garment pressure test which includes a plurality of human body sizes, without frequently changing the human body module (2), thereby realizing economic and effective garment functionality measurement.

11 Claims, 16 Drawing Sheets

(56) References Cited

U.S. PATENT DOCUMENTS

| | | | | |
|---|---|---|---|---|
| 12,070,094 | B2 * | 8/2024 | Bergenthal | A41H 5/01 |
| 2013/0238285 | A1 * | 9/2013 | Volchek | A41H 5/01<br>702/188 |
| 2019/0082762 | A1 * | 3/2019 | Chan | A41H 5/01 |

FOREIGN PATENT DOCUMENTS

| | | | | | |
|---|---|---|---|---|---|
| CN | 102494825 | B | * | 10/2013 | |
| CN | 105615094 | A | * | 6/2016 | |
| CN | 209609951 | U | | 11/2019 | |
| CN | 110736579 | A | * | 1/2020 | G01L 5/00 |
| CN | 211121719 | U | | 7/2020 | |
| CN | 113624383 | A | | 11/2021 | |
| WO | WO-2017160255 | A1 | * | 9/2017 | G01L 5/00 |

OTHER PUBLICATIONS

Wang et al., A smart mannequin system for the pressure performance evaluation of compression garments; Textile Research Journal 81(11); pp. 1113-1123.

B Yang et al., Smart bionic morphing leg mannequin for pressure assessment of compression garment; Smart Mater. Struct. 29 (2020) 055041.

* cited by examiner

MULTI-DIMENSIONAL INTELLIGENT GARMENT PRESSURE TEST DRESS FORM APPARATUS AND SYSTEM, AND MULTI-DIMENSIONAL INTELLIGENT GARMENT PRESSURE TEST METHOD

This application claims the priority of the Chinese patent application No. 202110943459.5 filed to the China Patent Office on Aug. 17, 2021, with the invention title "MULTI-DIMENSIONAL INTELLIGENT GARMENT PRESSURE TESTING MANNEQUIN DEVICE, SYSTEM AND METHOD", the disclosure of which is incorporated herein by reference in its entirety.

TECHNICAL FIELD

This application relates to the technical field of garment evaluation and design technologies, and in particular to a multi-dimensional intelligent garment pressure testing mannequin device, system and method.

BACKGROUND

With the continuous development of the economy, people's requirements for the comfort and functionality of garments are gradually increasing. Functional pressure garments have been widely used in daily fashions, sports, medical and rehabilitation cares, etc. The garment industry and market are having increasing demands for mechanical testing and fit analysis of functional garments. Garment pressure refers to the interface pressure generated between the inner layer of garment fabrics and the surface of human skin during the wearing of the garments, and its magnitude may affect the fabric tactility, garment wearing comfort, size fitness and mobility flexibility. Therefore, it is highly necessary to evaluate the garment pressure, size and shape under both static and dynamic conditions. A traditional human body model (mannequin) has a fixed model size form, and thus human body models of different size and shape have to be replaced when different human body size, shape and pressure are tested, making it impossible to carry out intelligent dynamic and form-adjustable multi-dimensional garment pressure testing, with greater limitations, lower testing efficiencies and higher costs.

SUMMARY

In view of this, the present application aims to provide a multi-dimensional intelligent garment pressure testing mannequin device, system and method, to achieve a cost-effective garment mechanics and morphology assessment.

In order to achieve the above technical objectives, this application provides a multi-dimensional intelligent garment pressure testing mannequin device, including a device body and a human body model;

the human body model is circumferentially divided into a plurality of model units along an axis;

the device body includes a plurality of movable parts and a control base;

each of the movable parts is circumferentially distributed on the control base around a circle center, and each of the movable parts is movably disposed on a straight line connecting its center point with said circle center;

each of the model units is installed on the respective movable part in a one-to-one correspondence;

the control base is employed to drive each of the movable parts to move together or separately, so that the sizes and shapes of the human body models can be adjusted and varied multi-dimensionally.

Further, the control base includes a base body, a driving mechanism and a controller;

the driving mechanism is installed on the base body, and is connected to each of the movable parts;

the controller is electrically connected to the driving mechanism.

Furthermore, a plurality of sliders are provided on the top of the base body;

each of the sliders is distributed radially around the circle center and corresponds to a respective movable part in a one-to-one correspondence;

each of the movable parts is slidably mounted on the slider in a one-to-one correspondence.

Furthermore, the movable parts are in a strip-shaped blade structure and are arranged vertically;

a plurality of the movable parts forms an encircled cylindrical structure with dynamically variable sizes and shapes.

Furthermore, a first mounting hole is provided on the outer arc surface of each of the movable parts;

each of the model units is provided with a second mounting hole that matches the first mounting hole.

Furthermore, a sensor installation site for installing a pressure sensor is provided on the outer surface of at least one of the model units.

Furthermore, the model unit provided with the sensor installation site is provided with a wiring channel that passes through itself and is communicated with the sensor installation site.

A multi-dimensional intelligent garment pressure testing mannequin system, including a processing terminal, a plurality of pressure sensors and the multi-dimensional intelligent garment pressure testing mannequin device;

a plurality of the pressure sensors are arranged on the surface of the human body model;

the processing terminal is electrically connected to the pressure sensors and the control base;

the processing terminal is used to drive the control base to control the movement of the movable parts;

the processing terminal is also used to obtain size-and-shape change data of the human body model, and the garment pressure data captured by the pressure sensors corresponding to the size-and-shape change, and to perform an analysis processing to obtain a result of the analysis processing.

Furthermore, the processing terminal is an integrated computer with a display;

the processing terminal is also used to display in real time the obtained size-and-shape change data of the human body model, the obtained garment pressure data captured by the pressure sensors, and the analysis and processing results obtained by the analysis processing.

A multi-dimensional intelligent garment pressure testing method, applied to the multi-dimensional intelligent garment pressure testing mannequin system, comprises:

the processing terminal determining test parameters in response to the test instructions triggered by an inspecting personnel;

the processing terminal driving the control base based on the test parameters to control the movements of the movable parts, and obtaining the size-and-shape change data of the human body model and the garment pressure data captured by the pressure sensors corresponding to the size-and-shape changes;

the processing terminal performing an analysis processing on the obtained data, to obtain analysis and processing results.

It can be seen from the above technical solutions that, the multi-dimensional intelligent garment pressure testing mannequin device provided by this application, divides the human body model into a plurality of model units circumferentially along an axis, and then installs the model units in a one-to-one correspondence to movable parts which are distributed circumferentially around a circle center and disposed in a moveable manner. By controlling the base to drive each movable part to move together or separately, multi-dimensional changes in the human body model size and shape are finally realized, such that an intelligent evaluation of personalized garment interface pressure for garments of different shapes can be realized in both static or dynamic states, without frequent replacements of the human body models in the garment pressure testing, enabling cost-effective testing operations.

It can be seen from the above technical solutions that, the multi-dimensional intelligent garment pressure testing system provided by this application, comprises the above-mentioned multi-dimensional intelligent garment pressure testing mannequin device, the pressure sensors, and the processing terminal. The system combined with the improved testing device can be used to measure the pressure distribution and variations exerted by the garment on the surface of the human model when the sizes and shapes of the human body model change synchronously or asynchronously; it may also dynamically test a plurality of parameters related to the garment shapes and mechanical properties, to realize real-time monitoring of the qualitative and quantitative relationships between the size-and-shape change and interface pressure of the measured garment under a 360-degree stretching condition, as well as to calculate and predict the wearing fatigue, the dimensional stability, and the mechanical change property of the garment under highly-frequently repeated stretches, and so forth. At the same time, the system can also be used for other functional garment tests, to improve the process of the garment in dynamic mechanical and size-and-shape performance testing, and to improve the physical and mechanical properties of the garment in terms of pressure, elasticity, fatigue, size/shape stability, and pressure comfort, so as to improve the quality control level of products.

BRIEF DESCRIPTION OF THE DRAWINGS

In order to explain the technical solutions of the embodiments of the present application or the prior art more clearly, the accompanying drawings needed to be used in the description of the embodiments or the prior art will be briefly introduced below. Apparently, the accompanying drawings described below are only some embodiments of the present application, and for those of ordinary skill in the art, other drawings can be obtained based on these accompanying drawings without exerting any creative effort.

Figure 13:
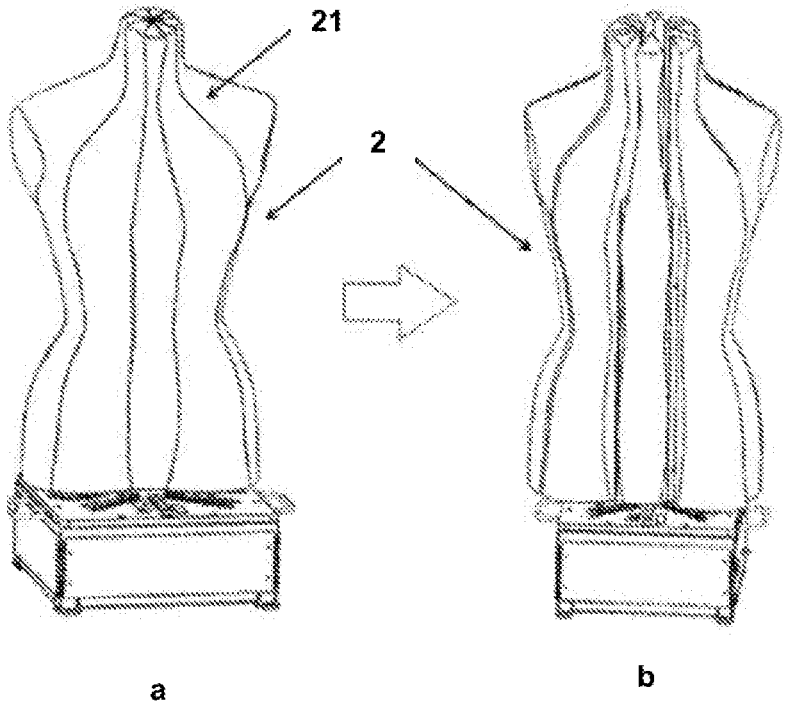
Figure 14:
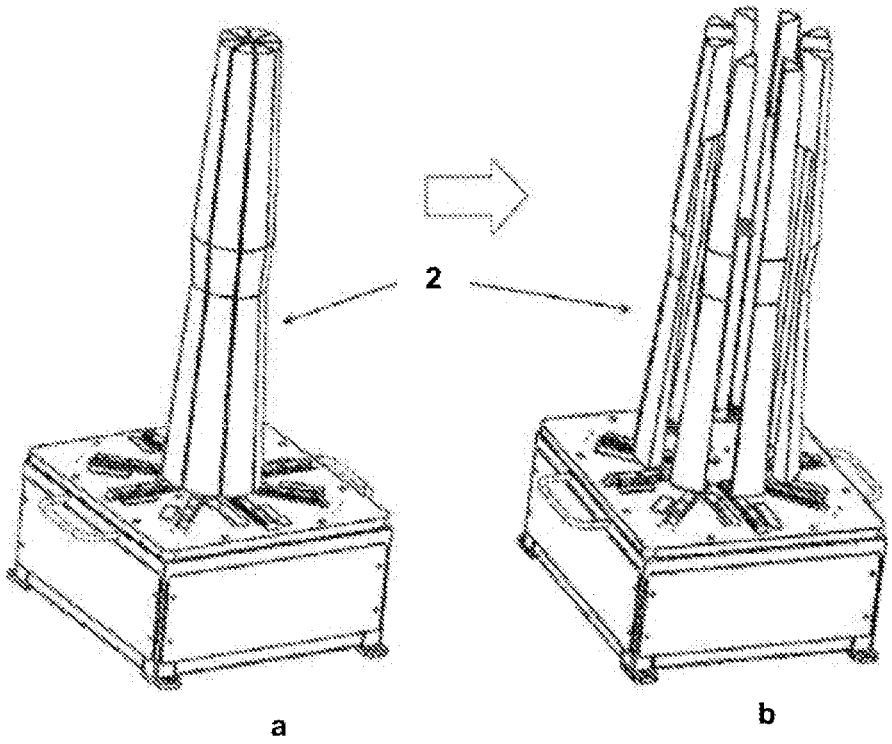
Figure 15:
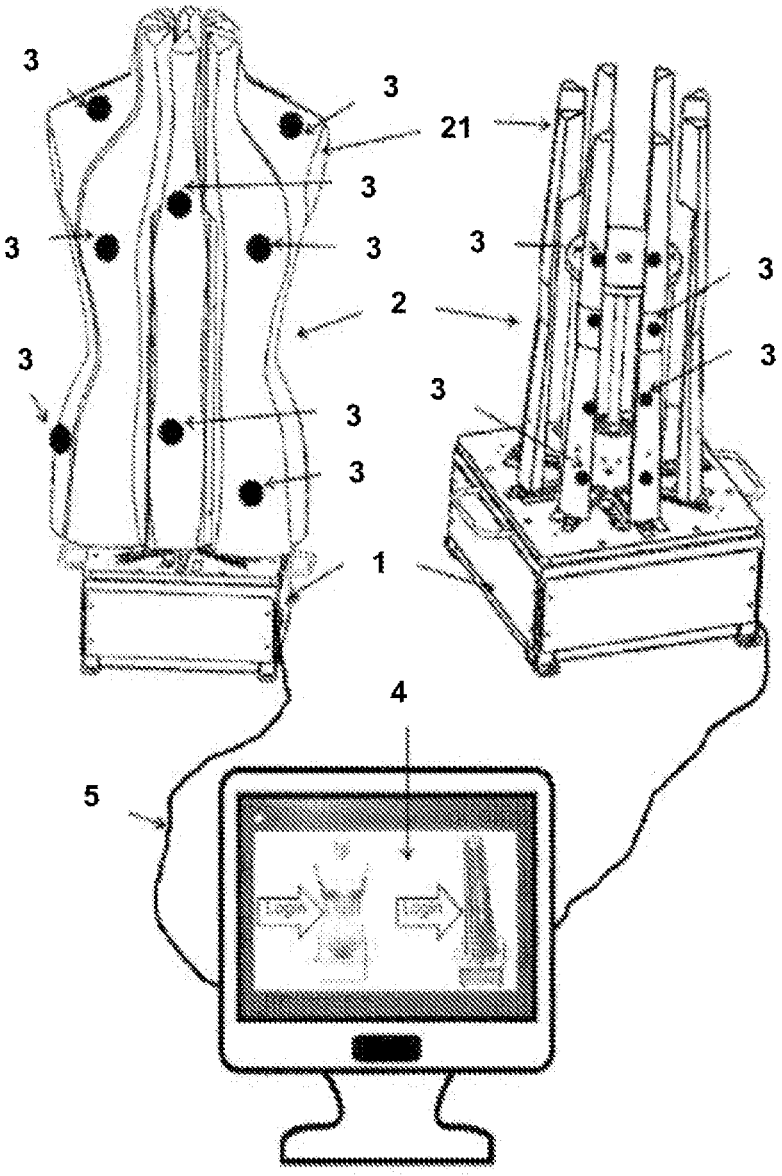
Figure 16:
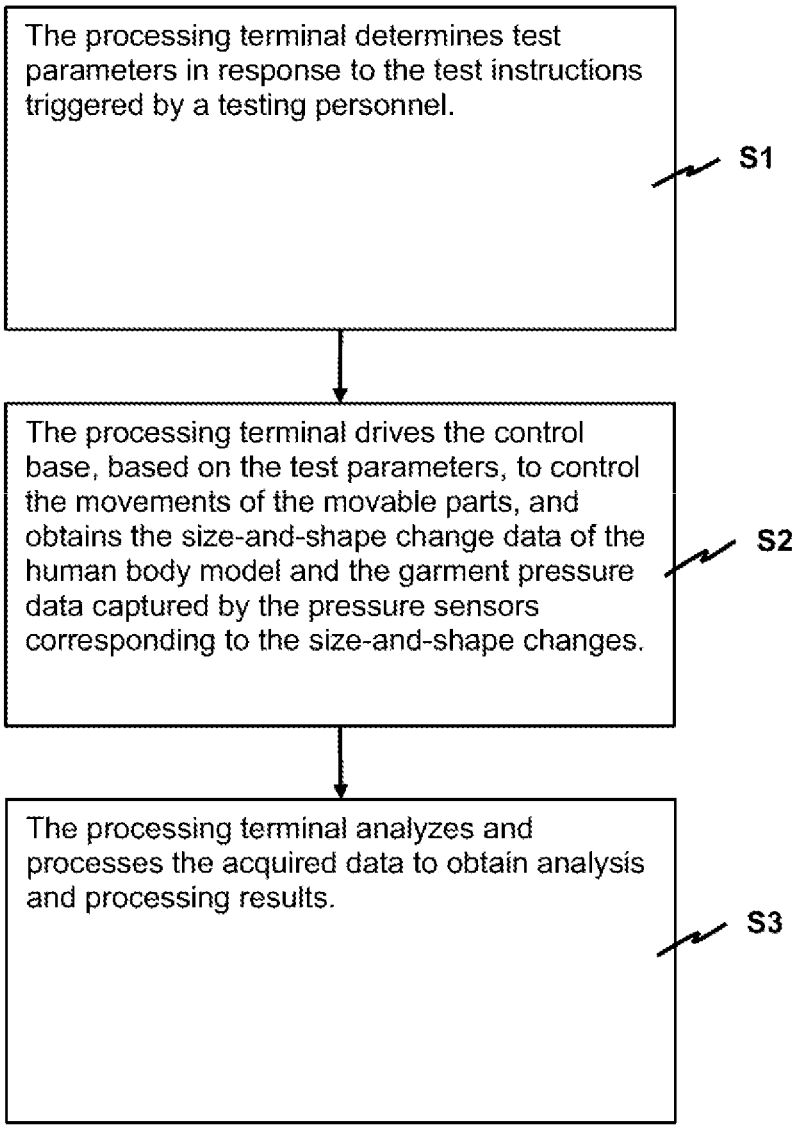

Figure a of FIG. 13 is a schematic structural diagram of a multi-dimensional intelligent garment pressure testing mannequin device provided in this application, with the human upper body model in its initial state;

Figure b of FIG. 13 is a schematic structural diagram of a multi-dimensional intelligent garment pressure testing mannequin device provided in this application, with the human upper body model in its expanded state;

Figure a of FIG. 14 is a schematic structural diagram of a multi-dimensional intelligent garment pressure testing mannequin device provided in this application, with the human lower limb model in its initial state;

Figure b of FIG. 14 is a schematic structural diagram of a multi-dimensional intelligent garment pressure testing mannequin device provided in this application, with the human lower limb model in its expanded state;

FIG. 15 is a schematic structural diagram of a multi-dimensional intelligent garment pressure testing mannequin system provided in this application;

FIG. 16 is a schematic flow chart of a multi-dimensional intelligent garment pressure testing method provided in this application.

In the accompany drawings: 1. Control base; 11. Base; 111. Slider; 112. Lifting car; 12. Driving mechanism; 120. Driver; 121. Threaded post; 122. Guide block; 1221. Notch; 1222. Roller; 123. Connecting rod; 1231. Chute; 124. Guide pillar; 2. Human body model; 21. Model unit; 211. First mounting hole; 3. Pressure sensor; 4. Processing terminal; 5. Communication line; 6. Movable parts; 61. Second mounting hole; 62. Wiring channel.

DETAILED DESCRIPTION

The technical solutions of the embodiments of the present application will be described clearly and completely below with reference to the accompanying drawings. Apparently, the described embodiments are a portion of the embodiments of the present application, rather than the entirety thereof. Based on the examples in the embodiments of this application, all other embodiments obtained by those of ordinary skill in the art without making creative efforts fall within the scope of protection of the embodiments of this application.

It should be noted that, in the description of the embodiments of this application, orientations or positional relationships indicated by the terms "center", "upper", "lower", "left", "right", "vertical", "horizontal", "inner", "outer" and so forth, are orientations or positional relationships illustrated on the basis of the accompanying drawings, which are only for the convenience of describing the embodiments of the present application and simplifying the description, but do not indicate or imply that the device or element referred to must have the specific orientations, or be configured or operating in the specific orientations; therefore they shall not be construed as limiting the embodiments of the present application. Furthermore, the terms "first", "second" and "third" are used for descriptive purposes only, but are not to be construed as indicating or implying relative importance.

It should be noted that, in the description of the embodiments of this application, unless clearly stated and specified otherwise, the terms "installation", "attachment" and "connection" should be understood in a broad sense; for example, they can be fixed connections, replaceable connections, or integral connections, and can be mechanical connections or electrical connections, and can be direct connections, indirect connections through an intermediary, or internal communications between two components. For those of ordinary skill in the art, the specific meanings of the above terms in the embodiments of the present application may be interpreted under specific situations.

The embodiment of the present application discloses a multi-dimensional intelligent garment pressure testing mannequin device.

Figure 1:
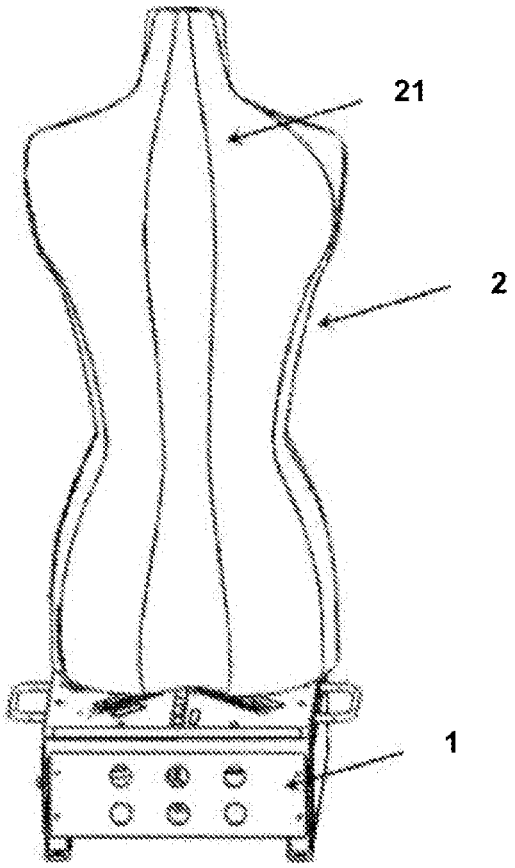
FIG. 1 is a schematic structural diagram of a multi-dimensional intelligent garment pressure testing mannequin device provided in the present application, with a human upper body model.
Figure 2:
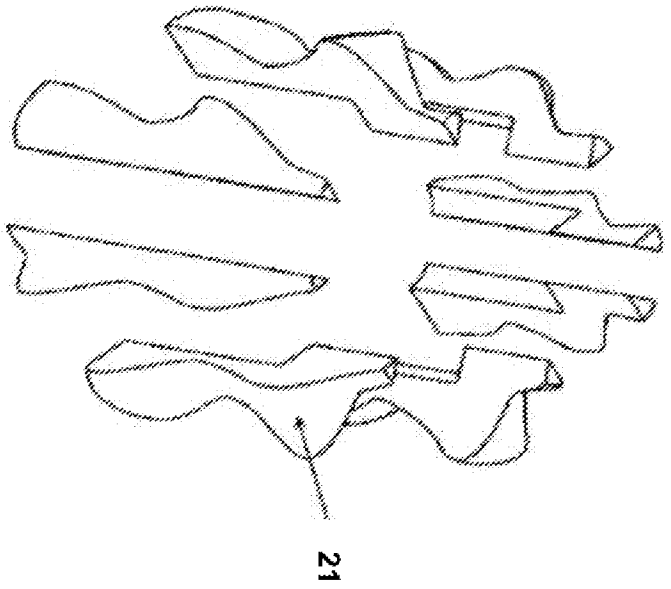
FIG. 2 is a schematic structural diagram of the human upper body model provided in this application in its expanded state.
Figure 3:
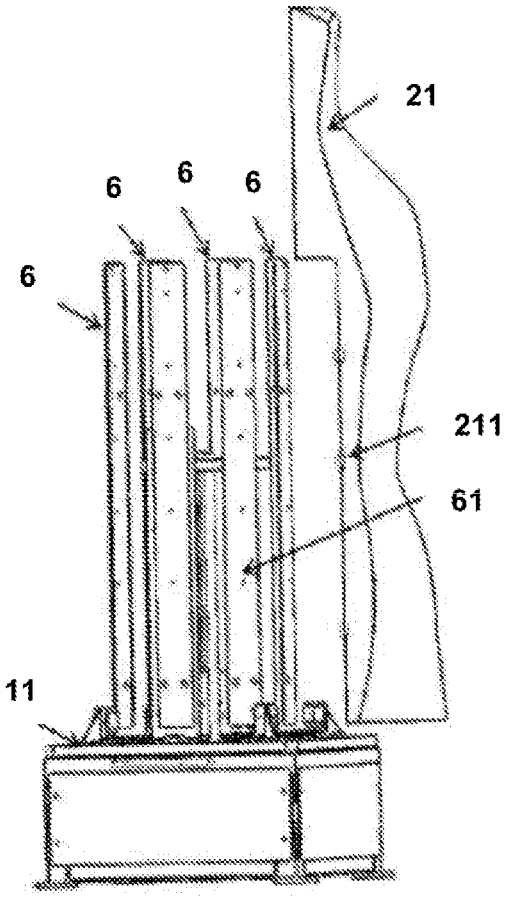
FIG. 3 is a schematic structural diagram of a multi-dimensional intelligent garment pressure testing mannequin device provided in this application, with a model unit of a human upper body model.
Figure 4:
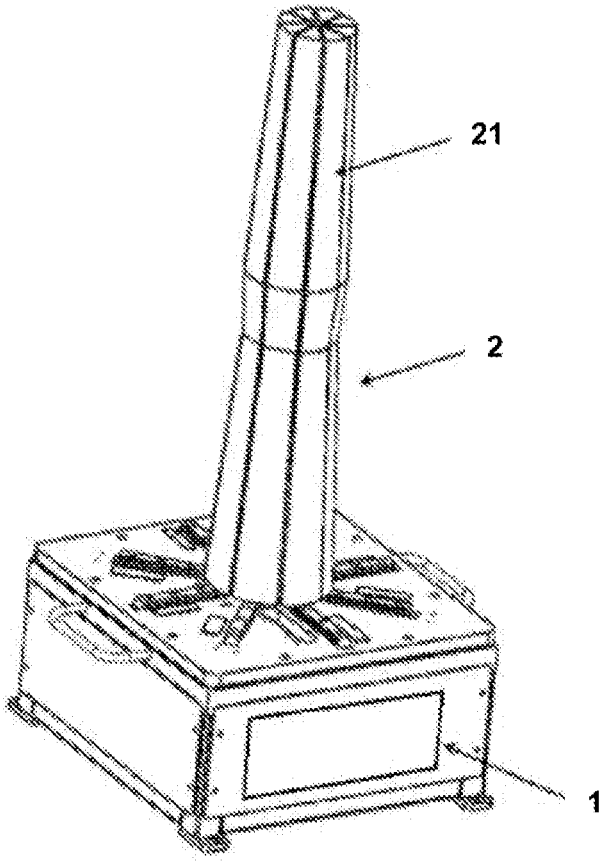
FIG. 4 is a schematic structural diagram of a multi-dimensional intelligent garment pressure testing mannequin device provided in this application, with a human lower limb model.
Figure 5:
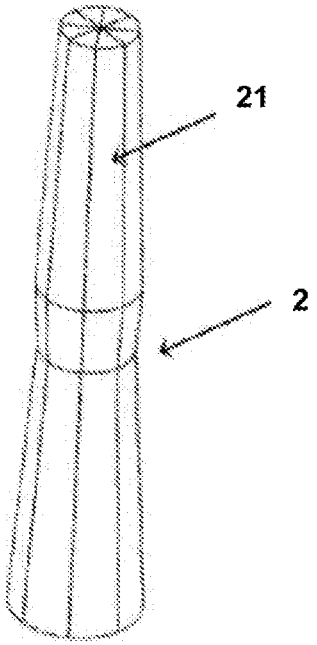
FIG. 5 is a schematic structural diagram of the human lower limb model provided in this application in its initial state.
Figure 6:
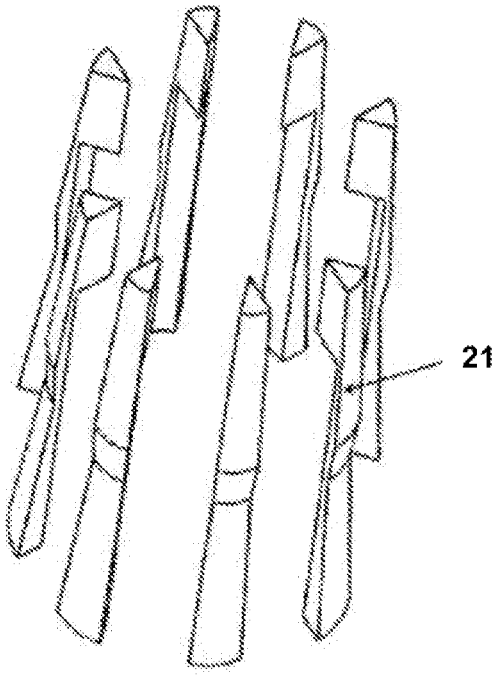
FIG. 6 is a schematic structural diagram of the human lower limb model provided in this application in its expanded state.

Please refer to FIGS. 1 to 7 and 11 to 14, an embodiment of a multi-dimensional intelligent garment pressure testing mannequin device provided in the embodiment of this application includes: a device body and a human body model 2. Among them, the human body model 2 is circumferentially divided into a plurality of model units 21 along an axis; that is, the human body model 2 is composed of a plurality of model units 21. The human body model 2 can specifically be a human upper body model as shown in FIG. 2, or a human lower limb model as shown in FIG. 5, etc.; specifically, it can be designed as a corresponding human body part according to actual needs without limitation. As for the preparation of each model unit 21, it can be prepared by 3D printing technology or conventional mechanical processing.

The device body includes a plurality of movable parts 6 and a control base 1. Among them, each of the movable parts 6 is distributed circumferentially on the control base 1 around a circle center, preferably distributed uniformly around a circumference; also, each of the movable parts 6 is movably disposed on a straight line connecting its center point and the circle center. The plurality of model units 21 are installed on the movable part 6 in a one-to-one correspondence. The control base 1 is used to drive the movable parts 6 to move together or separately, so that the size and shape of the human body model 2 can be adjusted and changed in a multi-dimensional manner. Specific motion control, for example, when the control base 1 controls the outward expansion movements of the movable parts 6, will drive the model unit 21 to move along therewith, and this in turn drives the human body model 2 to expand along therewith and thus change its size and shape, such as in the variation of the states shown in FIG. 13 and FIG. 14.

It can be seen from the above technical solutions that, the multi-dimensional intelligent garment pressure testing mannequin device provided by this application circumferentially divides the human body model 2 into a plurality of model units 21 along an axis, and then installs the model units 21 in a one-to-one correspondence to the movable parts 6 which are distributed circumferentially around the circle center and are movably disposed. By using the control base 1 to drive each of the movable parts 6 to move together or separately, multi-dimensional changes in the size and shape of the human body model 2 are finally realized, so that an intelligent evaluation of the garment interface pressure of the garment of different sizes and shapes is intelligently evaluated in a static or dynamic state, without frequent replacements of the human body model 2 during the garment pressure test, enabling cost-effective testing operations.

Figure 11:
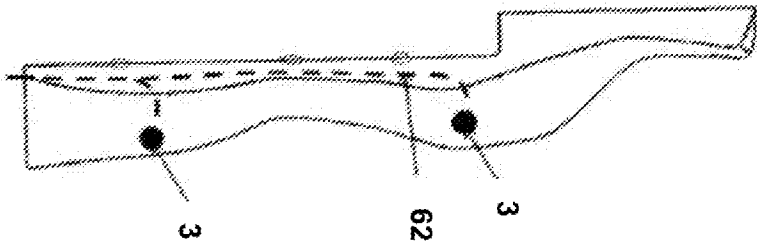
FIG. 11 is a schematic structural diagram of a multi-dimensional intelligent garment pressure testing mannequin device provided in this application, with a model unit of a human upper body model thereof being equipped with a pressure sensor.
Figure 12:
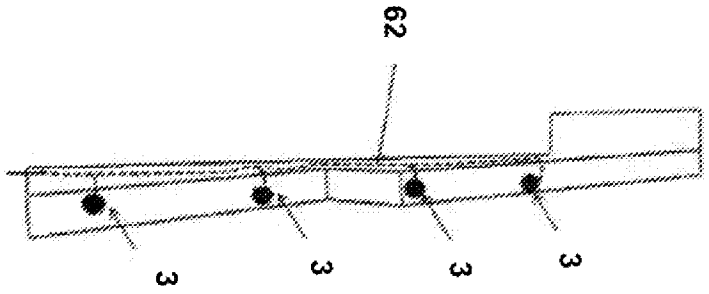
FIG. 12 is a schematic structural diagram of a multi-dimensional intelligent garment pressure testing mannequin device provided in this application, with a model unit of a human lower limb model thereof being equipped with a pressure sensor.

It should be noted that, the mannequin device disclosed in the present application can be used for pressure testing applications using the pressure sensor 3 as shown in FIGS. 11 and 12 during garment pressure testing. Of course, it is also possible to implement garment pressure testing by incorporating other detection devices or detection sensors instead of the pressure sensor 3. Moreover, the mannequin device is not limited to the applications in garment pressure testing, but can also be used in garment size testing or other purposes; those skilled in the art can make appropriate changes in applications based on this without limitation.

The above is the first embodiment of a multi-dimensional intelligent garment pressure testing mannequin device provided by the embodiment of the present application. The following is the second embodiment of a multi-dimensional intelligent garment pressure testing mannequin device provided by the embodiment of the present application; for details, please refer to FIG. 1 to FIG. 14.

Figure 8:
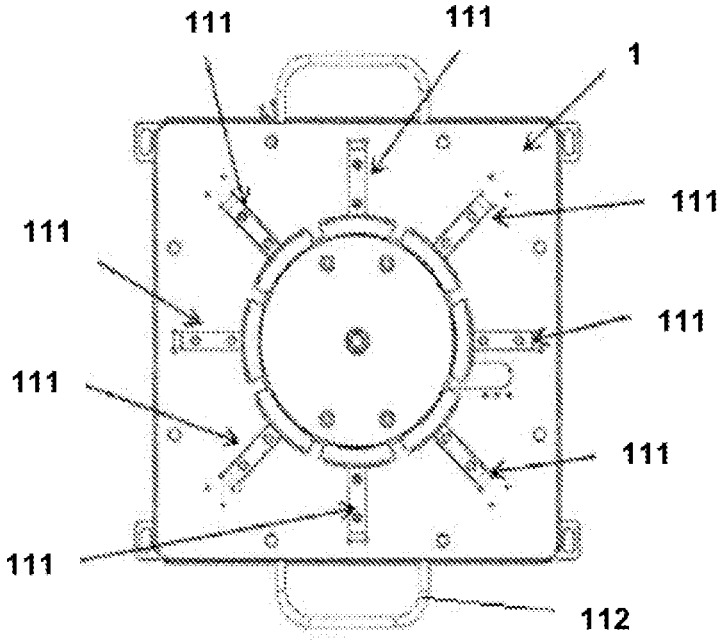
FIG. 8 is a top view of the main body of a multi-dimensional intelligent garment pressure-testing mannequin device provided in this application.

Technical solution based on the above-mentioned first embodiment:

Furthermore, as shown in FIG. 8, with respect to the structural composition of the control base 1, it includes a base body 11, a driving mechanism 12 and a controller (not shown in the Figure). The driving mechanism 12 is installed on the base body 11 and connected to each of the movable parts 6. The controller is electrically connected to the driving mechanism 12. In this embodiment, the structure of the base body 11 can be designed according to actual needs; for example, it can be designed as a square box structure as shown in the Figure, and at the same time, at least one pair of lifting ears 112 can be provided to facilitate its transportation, and there are no specific limitations. The controller may include a PLC control board, etc., and there are no specific limitations.

Furthermore, a plurality of sliders 111 are provided on the top of the base body 11. Among them, each of the sliders 111 is distributed radially around a circle center and corresponds to a respective movable part 6 in a one-to-one correspondence; each of the movable parts 6 is slidably installed on the slider 111 in a one-to-one correspondence. The installation of the movable parts 6 can be facilitated by the arrangement of the slider 111, and at the same time, the slider 111 also plays a guiding role, making the movements of the movable parts 6 more stable.

Furthermore, in order to form a larger installation surface and facilitate the installation and cooperation between the movable parts 6 and the model units 21, the movable parts 6 can be designed in a strip-shaped blade structure and be arranged vertically, and the cross-section of a movable part 6 can be arc-shaped. To this end, a plurality of movable parts 6 can enclose a cylindrical structure whose size and shape are dynamically variable. Of course, the movable parts 6 can also be in other structures, for example, it can be in a positioning post structure, and the bottom of a model unit 21 can be provided with a positioning hole for the positioning post to be inserted. During installation, the model unit 21 can be directly inserted into a movable part 6; those skilled in the art can make appropriate changes on this basis, and there are no specific limitations.

Figure 9:
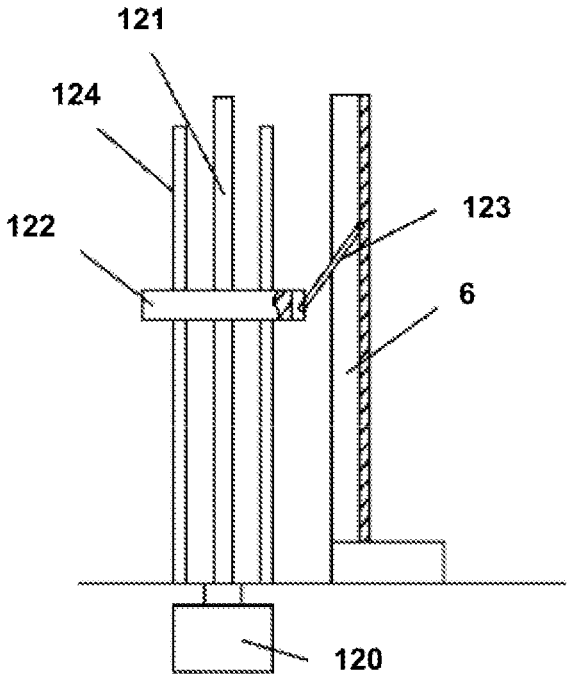
FIG. 9 is a schematic structural diagram of the first assembly of the driving mechanism of a multi-dimensional intelligent garment pressure testing mannequin device provided in this application.

As shown in FIG. 9, with respect to the specific composition of the driving mechanism 12, it may include a driver 120 and a linkage mechanism. The linkage mechanism may include a threaded post 121, a guide block 122 and a plurality of connecting rods 123. The threaded post 121 is arranged vertically and connected to the driver 120, and can be rotated under the control of the driver 120; the driver 120 is a servo motor that can realize forward and reverse rotations. The guide block 122 is sleeved on the threaded post 121 and is threadedly mated with the threaded post 121, while at the same time, the guide block 122 is limited in the radial direction and cannot rotate, but can only move up and down by cooperating with the threaded post 121, the restriction method can be to additionally set up a guide pillar 124 which is installed vertically on the top of the base 1 and passes through the guide block 122 so as to limit the rotation of the guide block 122, so that the guide block 122 can only move up and down along the guide pillar 124; furthermore, the threaded post 121 can be a screw, and the guide block 122 can be embedded with a screw nut that cooperates with the screw, so that the cooperation between the guide block 122 and the threaded post 121 is rendered smoother. A plurality of connecting rods 123 are distributed around the circumference of the guide block 122, with one end being hinged with the guide block 122, and the other end being hinged with the movable parts 6 designed in a strip-shaped blade structure, respectively. Since the bottom of a movable part 6 is restricted by the slider 111 and cannot move up and down, the driver 120 can be used to drive the threaded post 121 to rotate which in turn drives the guide block 122 to move up and down, which then drives the connecting rod 123 to swing up and down, and finally drives each movable part 6 to move horizontally along therewith.

Figure 10:
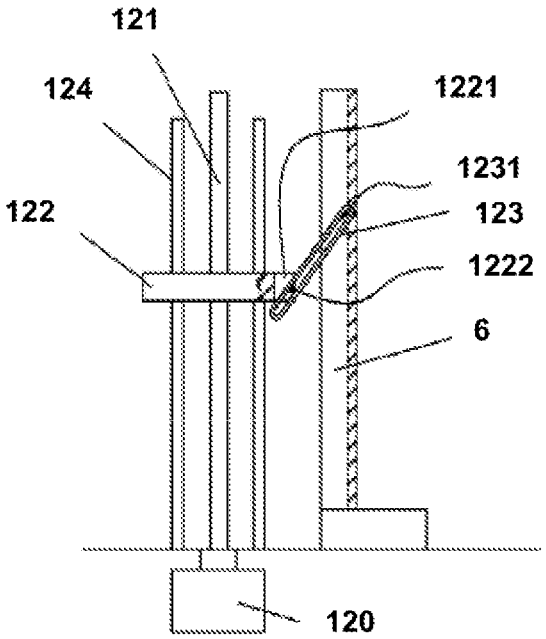
FIG. 10 is a schematic structural diagram of the second assembly of the driving mechanism of a multi-dimensional intelligent garment pressure testing mannequin device provided in this application.

As shown in FIG. 10, the connecting rods 123 can cooperate with the guide block 122 in another manner. For example, each of the connecting rods 123 is fixedly connected to the inner wall of a movable part 6 in a one-to-one correspondence, with the free ends thereof being inclined downward at a preset angle toward the threaded post 121; each connecting rod 123 being provided with a chute 1231 along its length direction. The guide block 122 is provided with a plurality of notches 1221 on its outer peripheral wall each corresponding to a respective connecting rod 123 in a one to one correspondence; each notch 1221 is for the free end of a corresponding connecting rod 123 to actively pass through, and each notch 1221 is rotatably connected with a roller 1222 which extends into the chute 1231 of a corresponding connecting rod 123. Each roller 1222 is in rolling contact with the inner wall of a corresponding chute 1231; that is, when the driver 120 controls the guide block 122 to move up and down, the movement of the roller 1222 is to move along the length direction of the corresponding chute 1231; since the connecting rods 123 are arranged fixedly and obliquely, the movement of the roller 1222 causes the connecting rods 123 to move relative to the threaded post 121 to approach or leave away the same, thereby realizing the driving of the movable parts 6.

Of course, the driving mechanism 12 may also include a plurality of drivers. Among them, each driver is connected to a respective movable part 6 in a one-to-one correspondence, and is used to drive the motion of the movable parts 6. Specifically, the driver may be one of an electric push rod, a hydraulic push rod, a pneumatic push rod, and a screw slide, or may be other driving structures without limitations. The design of a plurality of drivers can not only drive the movement of the movable parts 6 synchronously, but can also drive the movement of the movable parts 6 separately, providing more options for use.

Furthermore, taking the movable parts 6 being in a blade structure as an example, in order to achieve installation cooperation between the movable parts 6 and the model units 21, a first mounting hole 211 is provided on the outer arc surface of each movable part 6; correspondingly, each model unit 21 is provided with a second mounting hole 61 that matches the first mounting hole 211. The first mounting hole 211 and the second mounting hole 61 can be installed together through bolts, screws and other fasteners. In order to be adapted to the movable parts 6 designed with a strip-shaped blade structure, the bottom of the human body model 2 in the initial size and shape enclosed by the model units 21 forms an avoiding cavity to avoid each of the movable parts 6, ensuring that the model units 21 can normally enclose the initial size and shape of the human body model 2.

Furthermore, in order to facilitate the installation and layout of the pressure sensors 3, a sensor installation site (not shown in the figure) for installing a pressure sensor 3 is provided on the outer surface of at least one model unit 21. Among them, the sensor installation site can specifically be a groove structure to facilitate the embedded installation of a pressure sensor 3, and there are no specific limitations.

Figure 7:
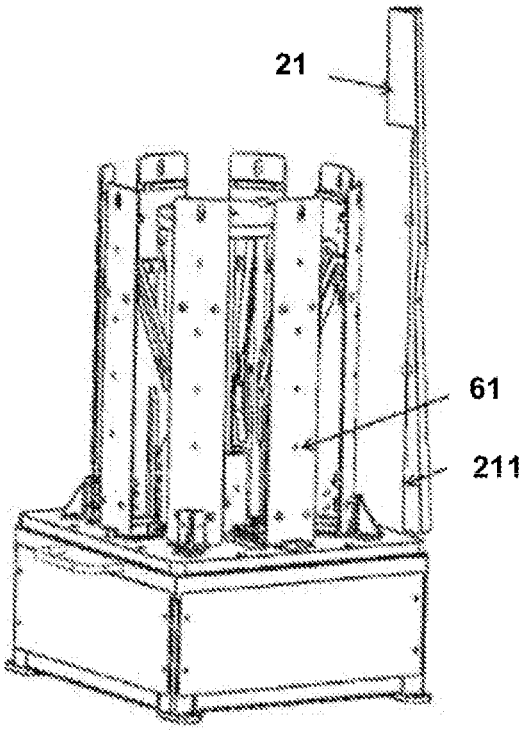
FIG. 7 is a schematic structural diagram of a multi-dimensional intelligent garment pressure testing mannequin device provided in this application, with a model unit of a human lower limb model.

Furthermore, in order to better hide the connection wires used to connect the pressure sensors 3, the connection wires are prevented from being placed on the surface of the model units 21 which may affect the test results. As shown in FIGS. 7 and 8, a model unit 21 provided with a sensor installation site is provided with a wiring channel 62 that penetrates the model unit 21 and communicates with the sensor installation site.

Taking the movable parts 6 in the strip-shaped blade structure design as an example, when the specific design is applied to the human upper body model, the diameter of the cylindrical structure enclosed by the movable parts 6 can be designed to be 110 mm-150 mm, and the height can be designed to be >450 mm. When applied to the human lower limb model, the diameter of the cylindrical structure enclosed by the movable parts 6 can be designed to be 60 mm-120 mm, and the height can be designed to be ≥550 mm. The movement stroke of the model units 21 of the human upper body model can be designed to be 0 mm-40 mm; that is, the size-and-shape change range of the human upper body model is from the initial closed state of 0 mm to the maximum open state of 40 mm. The movement stroke of the model units 21 of the human lower limb model can be designed to be 0 mm-60 mm; that is, the size-and-shape change range of the human lower limb model is from the initial closed state of 0 mm to the maximum open state of 60 mm. Through this design, it can be simulated that the upper body shoulder width of the human body varies in the range of 370 mm-415 mm, the chest circumference varies in the range of 820 mm-915 mm, the waist circumference varies in the range of 610 mm-720 mm, the hip circumference varies in the range of 850 mm-961 mm, the ankle circumference pre-varies in the range of 160 mm-300 mm, and the thigh circumference pre-varies in the range of 450 mm-700 mm. The standard range of Chinese women's garment models that this human upper body model can be applied to is from 155/80A, to 160/84A, and to 165/88A, and the international women's garment model range is from XS to M. Of course, the size and shape of the movable parts 6, the size and shape of the human body model 2, and so forth, can all be changed and designed according to actual needs, and the actual size-and-shape change range is not limited.

As shown in FIG. 15, this application also provides a multi-dimensional intelligent garment pressure testing mannequin system, including a processing terminal 4, a plurality of pressure sensors 3 and the multi-dimensional intelligent garment pressure testing mannequin devices of the above-mentioned first embodiment or second embodiment. Among them, a plurality of pressure sensors 3 are arranged on the surface of the human body model 2 of the multi-dimensional smart garment pressure testing mannequin device, and they can specifically be arranged on the surfaces of the corresponding model units 21 according to testing needs. Moreover, the pressure sensors 3 can be arranged on the model units 21 in a singular form or in a patterned plural form, without limitation. The pressure sensors in this application can be film pressure sensors, patch pressure sensors, or any other suitable pressure sensors, which are embedded on the surfaces of the model units 21.

A pressure sensor 3 can be electrically connected to the control base 1, and the collected data can be fed back to the processing terminal 4 through the control base 1. The processing terminal 4 and the control base 1 are connected through corresponding communication lines 5. Specifically, the processing terminal 4 is used to drive the control base 1 to control the movements of the movable parts 6, and the processing terminal 4 is also used to obtain the size-and-shape change data of the human body model 2 and the garment pressure data captured by the pressure sensors 3, and to perform an analysis processing to obtain an analysis processing result.

The system can be used to measure the pressure distribution and changes of garment on the surface of human body model 2 when the size and shape of the human body model 2 changes synchronously or asynchronously; it can also dynamically test a plurality of parameters related to the garment shapes and mechanical properties, so as to achieve real-time monitoring of the qualitative and quantitative relationships between the size-and-shape changes and interface pressures under 360-degree stretching of the garment, as well as the calculation and prediction of wearing fatigue, dimensional stability and mechanical change properties of the garment under highly frequently repeated stretching. At the same time, the system can also be used for other functional garment tests to improve the garment dynamic mechanics and the process of size-and-shape performance testing, to improve the physical and mechanical properties of the garment in terms of pressure, elasticity, fatigue, size-and-shape stability as well as pressure comfort, so as to improve the quality control level of products. In addition, it should be noted that a multi-dimensional intelligent garment pressure testing mannequin system can include a plurality of mannequin devices; for example, FIG. 11 includes two mannequin devices, and there are no specific limitations.

Furthermore, the processing terminal 4 can be an integrated computer with a display, or an intelligent mobile terminal such as a tablet or a mobile phone; the processing terminal 4 has test software running on it, without limitations. The processing terminal 4 is also used to display in real-time the obtained size-and-shape change data of the human body model 2, the obtained garment pressure data captured by the pressure sensors 3, and the analysis processing results obtained by the analysis processing. The processing terminal 4 with a display function can be installed independently of the control base 1 as shown in FIG. 15, or of course, it can be integrated into the control base I as shown in FIG. 4, without limitations.

Taking the processing terminal 4 being an integrated computer as an example, the garment pressure test process can be as follows:

a. wearing the garment to be tested on a human body model 2 on a corresponding control base 1; b. operating on the display interface of the processing terminal 4 and logging into the test software; c. selecting a pressure test mode and then setting the test parameters, and clicking to start the test; d. the processing terminal 4 driving the control base 1 to control the movements of the movable parts 6, so that the size and shape of the human body model 2 changes; f. during the change of the size and shape of the human body model 2, the processing terminal 4 obtaining in real time the size-and-shape change data of the human body model 2, and garment pressure data collected by pressure sensors 3, and displaying the same (the data displaying can be achieved via a conversion into size-and-shape change curves and pressure change curves, or in the form of a list), and at the same time, conducting quantitative and qualitative analysis on the acquired data, to analyze the pressure, elastic mechanical properties, fatigue, size-and-shape stability, pressure comfort, etc. of the garment fabric in the wearing state, and displaying it in real time with a three-dimensional dynamic image; g. after the completion of the test, a rating analysis and test report of pressure performance of the measured garment on the human body is given.

As shown in FIG. 16, this application also provides a multi-dimensional intelligent garment pressure testing method, which is applied to a multi-dimensional intelligent garment pressure testing mannequin system, comprising:

S1, the processing terminal determining test parameters in response to the test instructions triggered by the testing personnel. It should be noted that before the test operation, the layout and wiring of pressure sensors 3, the connection of the control base 1 and the processing terminal 4, and so forth, should be completed first, and then the garment should be worn on the human body model 2. The triggering of the test instructions can be realized by the operation of the testing personnel, wherein the testing personnel selects the pressure test mode through the operation interface of the processing terminal 4, and inputs the corresponding test parameters, and then clicks start to complete the triggering of the test instructions. The parameters include but are not limited to, for example, testing time, number of tests, movement speeds of the movable parts 6, and size-and-shape change range of the human body model 2.

S2, the processing terminal driving the control base based on the test parameters, to control the movements of the movable parts, and obtaining the size-and-shape change data of the human body model and the garment pressure data captured by the pressure sensors corresponding to the size-and-shape changes. It should be noted that the processing terminal 4 can drive the control base 1 to control the movements of the movable parts 6 based on the test parameters set in the pressure test mode selected by the testing personnel, so that the human body model 2 changes in sizes and shapes. In this application, the processing terminal 4 can obtain the data at the beginning of the first test, or record it only at the nth test, n>1, that is, after reaching the preset number of tests, it is considered to be in a stable state, and data acquisition is performed only at this time; for example, only during the fourth test, the processing terminal starts to record the data which is fed back by the pressure sensors, which means the previous three rounds of tests were all pre-tests, only driving the control base to control the human body model size and shape and make it change, wherein the garment to be tested is allowed to get adapted to the change in size and shape of the human body model, such that the values measured by the pressure sensors may become stable. Therefore, before step S2, the following steps can be added: the processing terminal only drives the control base to control the movements of the movable parts based on the test parameters until a plurality of the pre-tests is reached. The number of pre-tests is the number of runs required when the system reaches a stable operating state. Taking the number of pre-tests being three (3) as an example, in these three pre-tests runs, the processing terminal only drives the control base based on the test parameters to control the movements of the movable parts without acquiring data.

S3: The processing terminal analyzing and processing the acquired data to obtain analysis processing results. It should be noted that the specific method can be to conduct quantitative and qualitative analysis, to analyze the pressure, elastic mechanical properties, fatigue, size and shape stability, pressure comfort, etc. of the garment fabric in the wearing state, and finally provide a rating analysis, a test report and so forth, of the garment's pressure performance on the human body. Taking the processing terminal being an integrated computer as an example, during the process of analyzing the pressure, elastic mechanical properties, fatigue, size and shape stability, and pressure comfort of garment fabrics in the wearing state, it can be displayed in real time as a three-dimensional dynamic image.

A detailed introduction to a multi-dimensional intelligent garment pressure testing mannequin device, system, and method provided by this application is elaborated above, and for those of ordinary skill in the art, based on the gist of the embodiments of this application, modifications may be made in the specific implementation modes and application scopes. In summary, the contents of this specification should not be construed as a limitation to this application.

What is claimed is:

1. A multi-dimensional intelligent garment pressure testing mannequin device, said device comprising a device body and a human body model, wherein:

said human body model is circumferentially divided into a plurality of model units along an axis;

said device body comprises a plurality of movable parts and a control base;

each of said movable parts is circumferentially distributed on said control base around a circle center, and each of said movable parts is movably disposed on a straight line connecting a center point thereof with said circle center;

each of said model units is installed on a respective movable part in a one-to-one correspondence;

said control base comprises a base body, a driving mechanism and a controller;

said control base is configured to drive said movable parts to move together or separately such that said movable parts are individually controllable in movement, so that the size and shape of said human body model is adjustable and changeable multi-dimensionally;

said movable parts are in a strip-shaped blade structure, and are arranged vertically;

said movable parts enclose a cylindrical structure, the size and shape of which is dynamically variable; and a bottom of said human body model in the initial size and shape enclosed by said model units forms an avoiding cavity to avoid each of said movable parts, ensuring that said model units are able to normally enclose the initial size and shape of said human body model.

2. The multi-dimensional intelligent garment pressure testing mannequin device according to claim 1, wherein:

said driving mechanism is installed on said base body and connected to each of said movable parts; and said controller is electrically connected to said driving mechanism.

3. The multi-dimensional intelligent garment pressure testing mannequin device according to claim 2, wherein plural sliders are provided on a top of said base body, wherein:

each of said sliders is distributed radially around said circle center, and is in a one-to-one correspondence to a respective one of said movable parts; and each of said movable parts is slidably mounted on a respective one of said sliders in a one-to-one correspondence.

4. The multi-dimensional intelligent garment pressure testing mannequin device according to claim 3, wherein:

the driving mechanism includes a driver and a linkage mechanism, the driver and the linkage mechanism being collectively used for driving one or more movable parts in the plurality of movable parts, wherein the driver is operable to realize forward and reverse rotations;

the linkage mechanism includes a threaded post, a guide block and one or more connecting rods, wherein the threaded post is arranged vertically and connected to the driver such that the threaded post is rotatable under control of the driver, wherein the guide block is sleeved on and threadedly mated with the threaded post, and is limited to move up and down without rotation by cooperating with the threaded post, wherein the one or more connecting rods are distributed around a circumference of the guide block, the one or more connecting rods being respectively connected to the one or more movable parts such that an individual connecting rod of the one or more connecting rods is connected to a corresponding movable part of the one or more movable parts; and one end of the individual connecting rod is hinged with the guide block, and another end of the individual connecting rod is hinged with the corresponding movable part, whereby the individual connecting rod is driven to swing up and down when the driver rotates, causing the corresponding movable part to horizontally move on a corresponding slider among said sliders.

5. The multi-dimensional intelligent garment pressure testing mannequin device according to claim 3, wherein:

the driving mechanism includes a driver and a linkage mechanism, the driver and the linkage mechanism being collectively used for driving one or more movable parts in the plurality of movable parts, wherein the driver is operable to realize forward and reverse rotations;

the linkage mechanism includes a threaded post, a guide block and one or more connecting rods, wherein the threaded post is arranged vertically and connected to the driver such that the threaded post is rotatable under control of the driver, wherein the guide block is sleeved on and threadedly mated with the threaded post, and is limited to move up and down without rotation by cooperating with the threaded post, wherein the one or more connecting rods are distributed around a circumference of the guide block, the one or more connecting rods being respectively connected to the one or more movable parts such that an individual connecting rod of the one or more connecting rods is connected to a corresponding movable part of the one or more movable parts; and the individual connecting rod is fixedly connected to an inner wall of the corresponding movable part with a free end of the individual connecting rod being inclined downward at a preset angle toward the threaded post, the individual connecting rod being provided with a chute along a length direction of the chute, the guide block being provided with a plurality of notches on an outer peripheral wall of the guide block such that the individual connecting rod is associated with a corresponding notch in the plurality of notches, the corresponding notch being configured to allow the free end of the individual connecting rod to actively pass through, the corresponding notch being rotatably connected with a roller which extends into the chute, the roller being in rolling contact with an inner wall of the chute such that the roller moves along the length direction of the chute when the driver controls the guide block to move up and down, whereby a movement of the roller causes the individual connecting rod to approach or leave away from the threaded post, thereby driving of the corresponding movable part to move.

6. The multi-dimensional intelligent garment pressure testing mannequin device according to claim 1, wherein a first mounting hole is provided on an outer arc surface of each of said movable parts, and wherein:

each of said model units is provided with a second mounting hole that matches said first mounting hole.

7. The multi-dimensional intelligent garment pressure testing mannequin device according to claim 1, wherein a sensor installation site for installing a pressure sensor is provided on the outer surface of at least one of said model units.

8. The multi-dimensional intelligent garment pressure testing mannequin device according to claim 7, wherein said model unit provided with the sensor installation site is provided with a wiring channel that penetrates said model unit and communicates with the sensor installation site.

9. A multi-dimensional intelligent garment pressure testing mannequin system, said system comprising a processing terminal, a plurality of pressure sensors and the multi-dimensional intelligent garment pressure testing mannequin device as claimed in claim 1, wherein:

said pressure sensors are arranged on a surface of said human body model;

said processing terminal is electrically connected to said pressure sensors and said control base;

said processing terminal is used to drive said control base to control the movements of said movable parts; and said processing terminal is also used to obtain a size-and-shape change data of said human body model and a garment pressure data corresponding to size-and-shape changes, and to perform an analysis processing to obtain analysis processing results, wherein the garment pressure data is captured by said pressure sensors.

10. The multi-dimensional intelligent garment pressure testing mannequin system according to claim 9, wherein said processing terminal is an integrated computer with a display, and said processing terminal is also used to display in real time the obtained size-and-shape change data of said human body model, the obtained garment pressure data captured by said pressure sensors, and the analysis processing results obtained by the analysis processing.

11. A multi-dimensional intelligent garment pressure testing method, wherein the method is applied to the multi-dimensional intelligent garment pressure testing mannequin system as claimed in claim 9, and comprises:

said processing terminal determining test parameters in response to the test instructions triggered by an inspecting personnel;

said processing terminal driving said control base based on the test parameters, to control the movement of the movable parts, and obtaining the size-and-shape change data of said human body model and the garment pressure data captured by said pressure sensors in response to the size-and-shape changes;

said processing terminal analyzing and processing the acquired data to obtain analysis and processing results.

* * * * *